US008636557B2

(12) United States Patent
Lo

(10) Patent No.: US 8,636,557 B2
(45) Date of Patent: Jan. 28, 2014

(54) ROTATIONAL BUBBLE GENERATING APPARATUS WITH NON-SPILL RESERVOIR

(75) Inventor: Wai Chung Lo, Tsuen Wan (HK)

(73) Assignee: Wing Hing Manufacturing Co. Ltd. (CN)

( * ) Notice: Subject to any disclaimer, the term of this patent is extended or adjusted under 35 U.S.C. 154(b) by 29 days.

(21) Appl. No.: 13/353,108

(22) Filed: Jan. 18, 2012

(65) Prior Publication Data

US 2012/0214378 A1 Aug. 23, 2012

Related U.S. Application Data

(60) Provisional application No. 61/433,940, filed on Jan. 18, 2011, provisional application No. 61/582,761, filed on Jan. 3, 2012.

(51) Int. Cl.
*A63H 33/28* (2006.01)

(52) U.S. Cl.
USPC ..... 446/15

(58) Field of Classification Search
USPC ..... 446/15–21; 40/406–408
See application file for complete search history.

(56) References Cited

U.S. PATENT DOCUMENTS

| | | | | |
|---|---|---|---|---|
| 2,452,794 | A * | 11/1948 | Saachy | 40/408 |
| 3,100,947 | A * | 8/1963 | Hellman | 446/16 |
| 3,913,260 | A * | 10/1975 | Corbett | 446/16 |
| 4,044,496 | A * | 8/1977 | Jernstrom | 446/16 |
| 5,832,969 | A * | 11/1998 | Schramm | 141/98 |
| 6,062,935 | A * | 5/2000 | Gross | 446/15 |
| 6,416,377 | B1 * | 7/2002 | Bart | 446/15 |
| 6,860,782 | B2 * | 3/2005 | Hornsby et al. | 446/15 |
| 7,056,182 | B2 * | 6/2006 | Wan | 446/15 |
| 7,182,665 | B2 * | 2/2007 | Thai | 446/15 |
| 2002/0061697 | A1 * | 5/2002 | Hornsby et al. | 446/15 |
| 2003/0176138 | A1 | 9/2003 | Thai | |
| 2003/0228824 | A1 * | 12/2003 | Thai | 446/15 |
| 2007/0037467 | A1 * | 2/2007 | Thai | 446/15 |

(Continued)

FOREIGN PATENT DOCUMENTS

| | | |
|---|---|---|
| CN | 2930817 | 8/2007 |
| CN | 2930817 Y | 8/2007 |

(Continued)

OTHER PUBLICATIONS

International search report and written opinion of international searching authority in PCT/IB2012/000195 dated Jul. 26, 2012.

(Continued)

*Primary Examiner* — Gene Kim
*Assistant Examiner* — Alyssa Hylinski
(74) *Attorney, Agent, or Firm* — Baker & McKenzie LLP

(57) ABSTRACT

A hand-held bubble generating apparatus designed to mimic the appearance of a gun or a cannon. A housing may be coupled with a non-spill reservoir, and bubble generating liquid may be stored in the non-spill reservoir. A tube may communicate the bubble generating liquid from the reservoir to a bubble assembly support inside the housing. The bubble assembly support may hold a rotational bubble ring comprising a plurality of individual rings spaced about the outer circumference. When rotated proximate to and across a liquid dispensing section, each individual ring may receive enough bubble generating liquid to form a film across each ring. By rationing the amount of bubble liquid released on each individual ring, the device can incorporate a closed, non-spill reservoir. When air is generated and blown through the film of bubble generating liquid on each of the individual rings of the rotational bubble ring, bubbles are produced.

19 Claims, 10 Drawing Sheets

(56) References Cited

U.S. PATENT DOCUMENTS

| | | | | |
|---|---|---|---|---|
| 2009/0142986 | A1 | 6/2009 | San | |
| 2009/0227173 | A1* | 9/2009 | Thai | 446/15 |

FOREIGN PATENT DOCUMENTS

| | | | |
|---|---|---|---|
| CN | 200991595 | Y | 12/2007 |
| CN | 201361457 | Y | 12/2009 |
| JP | 2008-295924 | | 11/2008 |
| KR | 20-2010-0004890 | | 1/2010 |
| KR | 20-2010-0004890 | U | 5/2010 |

OTHER PUBLICATIONS

Notice of Reasons for Rejection in Japanese application No. 2013-548906 dated Dec. 10, 2013.

* cited by examiner

ROTATIONAL BUBBLE GENERATING APPARATUS WITH NON-SPILL RESERVOIR

PRIORITY TO RELATED APPLICATIONS

This utility applications claims priority to U.S. Provisional Application No. 61/433,940, filed Jan. 18, 2011, and U.S. Provisional Application No. 61/582,761, filed Jan. 3, 2012, the contents of which are herein incorporated by reference in their entirety.

TECHNICAL FIELD

The present disclosure relates to a bubble generating apparatus, and more particularly, a bubble generating apparatus having a rotational bubble ring structure and a non-spill reservoir.

BACKGROUND

There are many different types of known bubble generating mechanisms. In one approach, a film of bubble generating liquid is formed across one or more bubble rings and air is directed through the opening in each of the rings by a fan to form bubbles. Such an approach may be embodied in a variety of final products, such a stationary bubble machine or a hand-held apparatus. The final product may include a variety of components depending on various design requirements. Known bubble generating mechanisms generally include a reservoir of solution that allows the one or more bubble rings to be submersed into the bubble generating solution. However, these mechanisms require the solution reservoir to be open to the environment in order to allow the bubble rings to be submersed into the reservoir and form a film across the bubble rings. When the solution reservoir is open to the environment, the bubble generating solution can easily be spilled and wasted, which can cause internal corrosion or mechanical failures in the bubble generating apparatus, shortening the lifetime of the product.

SUMMARY

Disclosed embodiments may comprise a bubble generating apparatus that may be a hand-held bubble generating apparatus or other type of apparatus. The apparatus may be designed to mimic the appearance of a gun, a cannon, or any other device that may be desired to generate bubbles. A housing may be coupled with a non-spill reservoir, and the bubble generating liquid may be stored in the non-spill reservoir. A tube or other device may communicate the bubble generating liquid from the reservoir to the bubble assembly support inside the housing. The bubble assembly support may hold a rotational bubble ring comprising a plurality of individual rings spaced about the outer circumference of the rotational bubble ring. When rotated proximate to and across a liquid dispensing section, each individual ring may receive only enough of the bubble generating liquid to form a film across each ring required to generate a bubble. By rationing the amount of bubble liquid released on each individual ring instead of submersing the individual rings within a bubble generating liquid reservoir, the device can incorporate a closed, non-spill reservoir. When air is generated and blown through the film of the bubble generating liquid on each of the individual rings of the rotational bubble ring, bubbles are produced.

DETAILED DESCRIPTION

Figure 1:
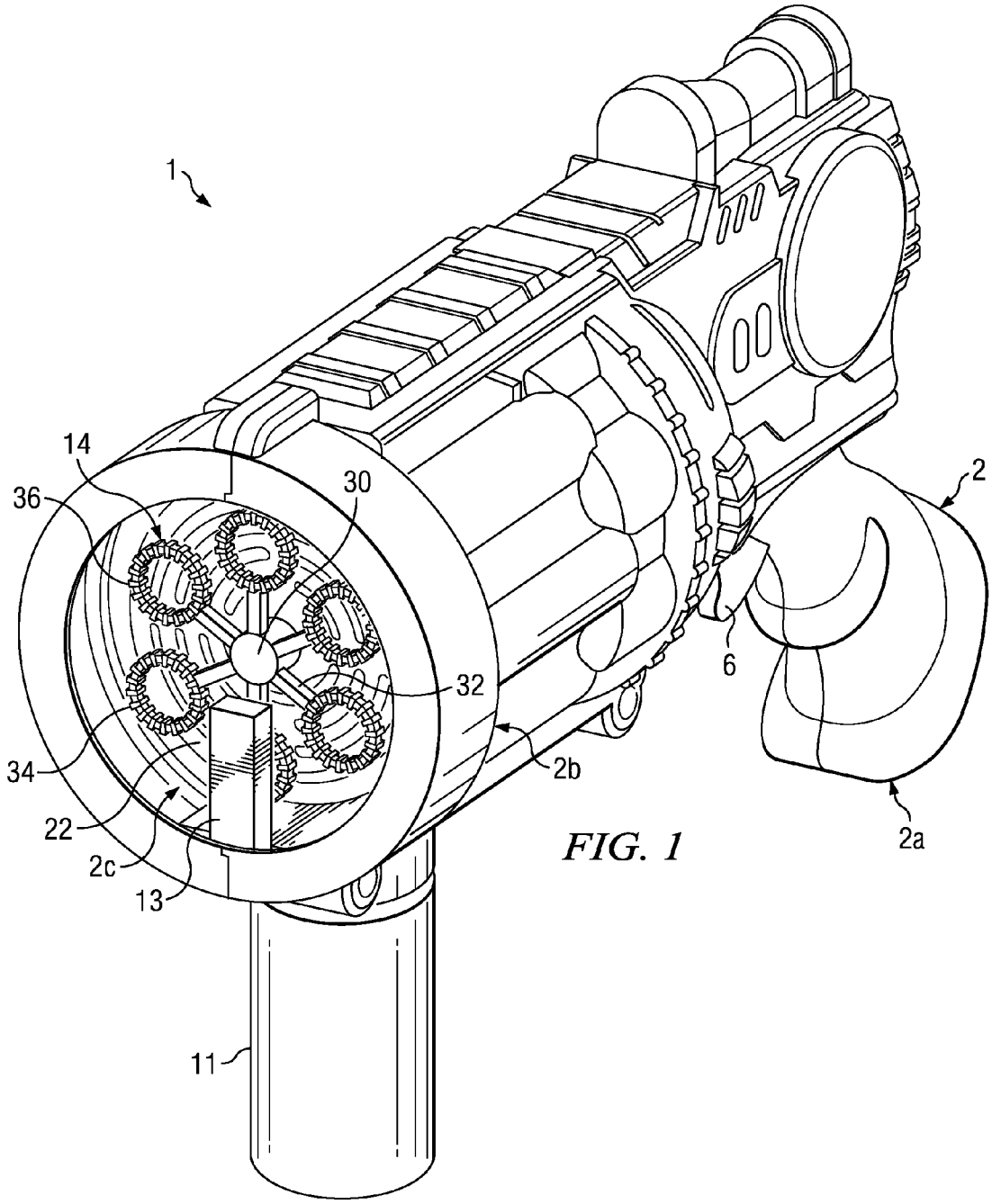
FIG. 1 is a perspective view of a bubble generating apparatus, in accordance with the present disclosure.

FIG. 1 is a perspective view of a bubble generating apparatus 1 comprising a housing 2, a trigger 6, a reservoir 11, a liquid dispensing section 13, a rotational ring structure 14, and a vented protective cover 22. As shown in FIG. 1, the bubble housing 2 and the reservoir 11 are designed to give the bubble generating apparatus 1 the appearance of a gun, although the bubble generating apparatus 1 may be designed to mimic a cannon or any other device desired to generate bubbles. In an exemplary embodiment of the housing 2, the housing 2 may comprise a barrel section 2*b* and handle section 2*a* extending therefrom. In an embodiment, the bubble generating apparatus 1 may be designed to be stationary and may not include a handle section. The bubble generating apparatus 1 of FIG. 1 will be described in more detail in FIGS. 2-4.

Figure 2:
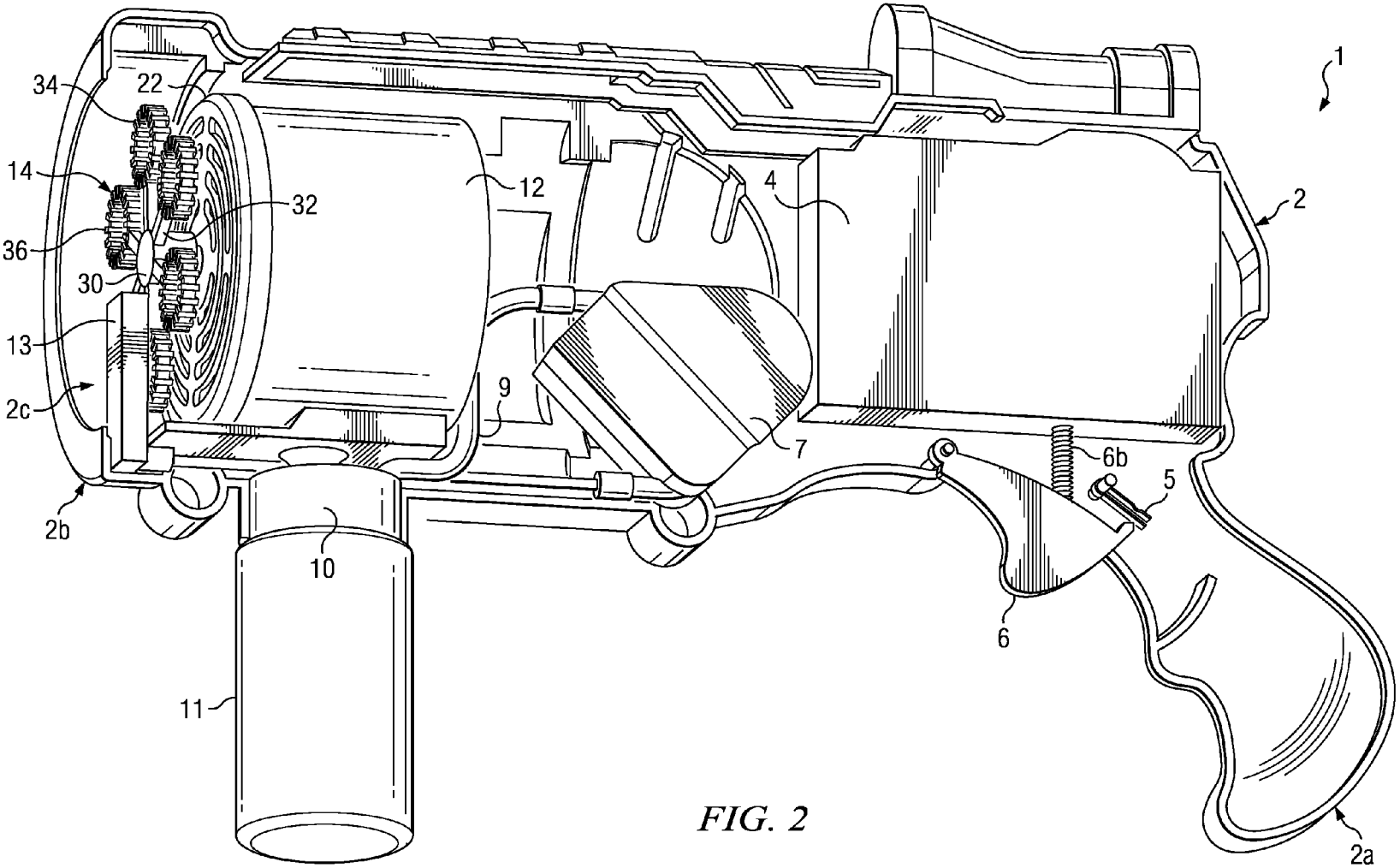
FIG. 2 is a partial cross-sectional view of a bubble generating apparatus of FIG. 1 with a housing cut away to expose parts of the apparatus and a reservoir connected to the housing, in accordance with the present disclosure.
Figure 3:
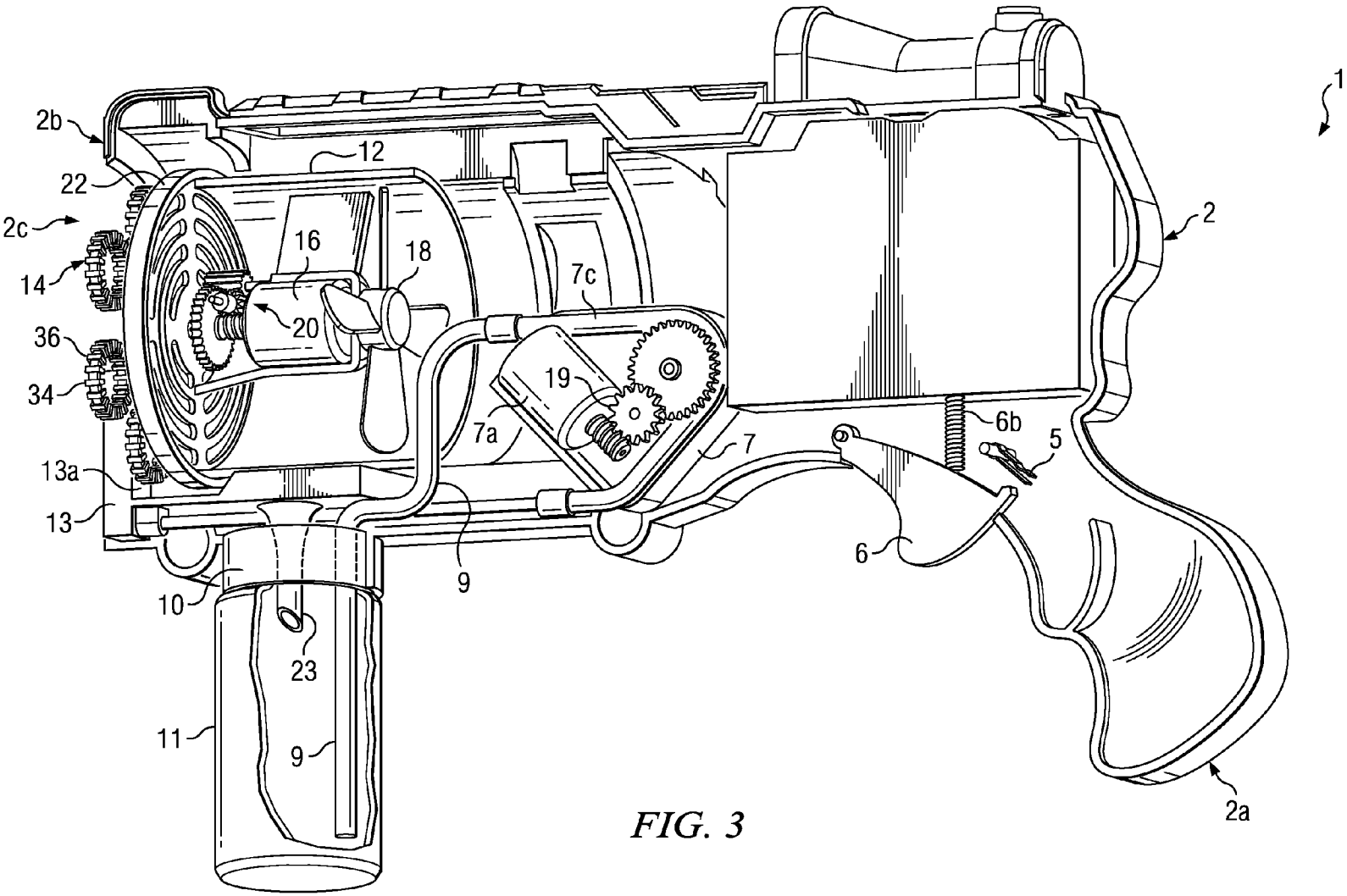
FIG. 3 is a partial cross-sectional view of the bubble generating apparatus of FIGS. 1-2 with the housing cut away to expose parts of the apparatus, motor covers cut away to expose parts of a bubble generating mechanism, and the reservoir removed to expose parts of a bubble generating mechanism, in accordance with the present disclosure.

FIG. 2 is a partial cross-sectional view of the bubble generating apparatus 1 of FIG. 1 with the housing 2 cut away to expose internal parts of the apparatus 1 and the reservoir 11 removably connected to the housing 2. FIG. 3 is a partial cross-sectional view of the bubble generating apparatus 1 of FIGS. 1-2 with first and second motor housings 7, 12 cut away to expose additional parts of the bubble generating apparatus 1 and the reservoir 11 cut away to expose components of the reservoir 11, The reservoir 11 may be configured to hold bubble generating liquid (not shown) and may be coupled with the housing 2 by a reservoir connector 10. The reservoir 11 may be configured in a variety of shapes. For example, the reservoir 11 may be a cylindrical container as illustrated in FIG. 2, or may be any other shape as desired. In an embodiment, the reservoir 11 and the reservoir connector 10 may be disposed proximate to an opening 2*c* in the housing 2 and opposite the handle 2*a* of the housing 2. The reservoir connector 10 may include one or more of a variety of coupling mechanisms for coupling the reservoir 11 to the housing 2. In an exemplary embodiment, the reservoir connector 10 may include a threaded recessed area for receiving a corresponding threaded top portion of the reservoir 11. It is to be appreciated that other suitable coupling mechanisms may be used, such as a mechanical latch or an interference fit. The reservoir connector 10 may be either integrally formed with or removably attached to the housing 2.

When the reservoir 11 is coupled to the housing 2 via the reservoir connector 10, the reservoir connector 10 may provide a cover over the reservoir 11 and cooperate with the reservoir 11 to provide a substantially enclosed space for retaining the bubble generating liquid within the reservoir 11. The reservoir connector 10 may include one or more small openings (not shown) defined therein to allow for the withdrawal of the bubble generating liquid from the reservoir 11 and the drainage of the bubble generating liquid back into the reservoir 11. In an embodiment, the small openings are formed discontinuously such that the drainage of the returning liquid into the reservoir 11 via a drain 23 does not interfere with the withdrawal of the liquid from the reservoir 11 via tubing 9. A first end of the tubing 9 may extend into the reservoir 11 and into the bubble generating liquid (not shown). The tubing 9 may extend through the housing 2 to engage a first plurality of gears 19 located in the first motor housing 7 and may end at a second end of the tubing 9 proximate to the bubble generating dispensing section 13.

The bubble generating dispensing section 13 may include internal conduits for allowing bubble generating liquid from the tubing 9 to pass through and be dispensed onto the rotational ring structure 14 to form bubbles. In an embodiment, the bubble generating dispensing section 13 may be integrally molded with the housing 2. The bubble generating dispensing section 13 may be positioned near a front portion of the barrel 2*b* of the housing 2. In another embodiment, the bubble generating dispensing section 13 may be a modular component of and removably attached to the housing 2. The bubble generating dispensing section 13 is shown in more detail in FIG. 4.

In some embodiments, the apparatus 100 may include the trigger 6 extending from the handle section 2*a* of the housing 2. The trigger 6 can be moved by pressure from the grasp of the person operating the apparatus 100 through a spring 6*b*. In an exemplary embodiment, the housing 1 encloses the first motor housing 7 and the second motor housing 12, which may each support an electric motor. The first motor housing 7 may enclose and support a first motor 7*a* and the second motor housing 12 may enclose and support a second motor 16. In an embodiment, the motors 7*a*, 16 may be powered by a power source. In an embodiment, the power source may be batteries (not shown) housed in a battery compartment 4, and when the trigger 6 is engaged, an electrode 5 may establish an electrical connection to the batteries to activate the electric motors 7*a*, 16.

The rotational ring structure 14 may be located proximate to the second motor housing 12 at the front of the barrel section 2*b* of the housing 2. Located within the housing 2, the web-like vented protective cover 22 may be disposed between the rotational ring structure 14 and the second motor housing 12, and the vented protective cover 22 may be configured to keep any external debris out of the internal compartments of the housing 2 of the bubble generating apparatus 1. A fan 18 may be disposed within the second motor housing 12 and may be connected to the second motor 16 at a first end of the motor 16 proximate to the handle 2*a* of the housing 2. A second plurality of gears 20 may be connected to the second motor 16 at a second end of the motor 16 proximate to the opening 2*c* of the housing 2. In operation, the second motor 16 may simultaneously rotate the fan 18, blowing air in an outward direction through the vented protective cover 22 and out of the opening 2*c* of the housing 2, and rotate the second plurality of gears 20 effectuate a rotation of the rotational ring structure 14.

The rotational ring structure 14 may be coupled to the second plurality of gears 20 at a central pivot 30 through the vented protective cover 22, and a plurality of arms 32 may extend outwardly from the central pivot 30. Individual bubble rings 34 may be disposed at the ends of the arms 32 and spaced circumferentially about the rotational ring structure 14 from each other. Each individual bubble ring 34 may be configured to include a plurality of radial ridges 36 operable to help evenly spread the bubble generating liquid across the opening of each ring 34 in order to create a film. In an embodiment, the ridges 36 extending radially from an inner edge of the ring 34 to an outer edge of the ring 34 may be disposed on a front surface of each ring 34 facing away from the interior of the housing 2. In another embodiment, similar ridges 36 may be disposed on the front surface and a back surface of each ring 34 facing towards the interior of the housing 2. In the illustrated embodiment, the ridges 36 may extend from a front surface, around an edge surface, and then to a back surface of each ring 34.

It is to be appreciated that the number, size, and orientation of the individual bubble rings 34 may vary depending on the various design considerations of a specific embodiment of the bubble generating apparatus 1. In one embodiment, the rotational ring structure 14 may comprise six individual bubble rings 34, although in other embodiments, the rotational ring structure 14 may be configured with fewer or more individual rings 34 to allow for fewer or more bubbles. The size of the rings 34 may be varied to generate bubbles of different sizes. The orientation of the individual rings 34 may be varied depending on the desired directions of the bubble streams.

The bubble generating dispensing section 13 may include a plurality of liquid outlets 13*a* aligned along a substantially vertical axis proximate the rotational ring structure 14. The bubble generating dispensing section 13 may be located at the front of the barrel of the housing 2 and may be operable to dispense bubble generating liquid via the plurality of liquid outlets 13*a* onto each of the individual bubble rings 34. The rotational ring structure 14 may either be in direct contact with the bubble generating dispensing section 13 or close enough to the bubble generating dispensing section 13 so that the bubble generating liquid can be applied directly from the bubble generating dispensing section 13 via the plurality of liquid outlets 13*a* onto the individual bubble rings 34 on the rotational ring structure 14. The proximity between the bubble generating dispensing section 13 and the rotational ring structure 14 may be configured to allow for a film of bubble generating liquid to form over the bubble rings 34 with minimized excess. In an embodiment, the plurality of liquid outlets 13*a* may be oriented to create a substantially uniform pressure across the bubble generating dispensing section 13, which may further improve the control over the thickness of the film of liquid formed over the bubble rings 34 and reduce excess.

In an embodiment, the bubble generating dispensing section 13 may be disposed between the rotational ring structure 14 and the second motor housing 12. In the illustrated embodiment, the bubble generating dispensing section 13 is disposed in front of the rotational ring structure 14 such that the rotational ring structure 14 is located between the second motor housing 12 and the bubble generating dispensing section 13.

Figure 4:
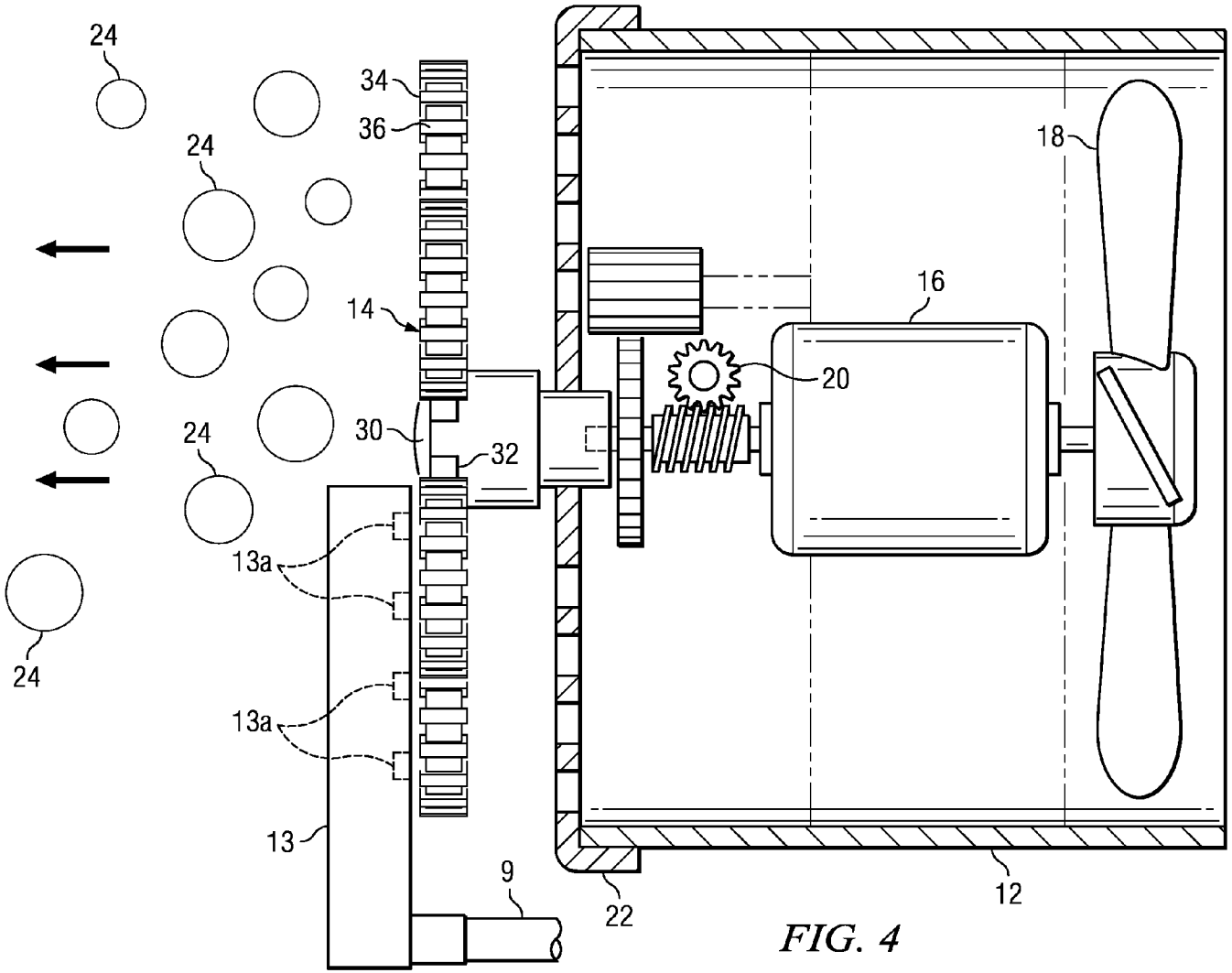
FIG. 4 is a partial cross-sectional view of the second motor housing of FIGS. 1-3 cut away to expose parts of the bubble generating apparatus, in accordance with the present disclosure.

FIG. 4 is a partial cross-sectional view of the second motor housing 12 of FIGS. 1-3 cut away to expose internal components of the bubble generating apparatus. As can be seen in FIG. 4, the second motor housing 12 may house the second motor 16. The second motor 16 may drive the fan 18 at a first end of the second motor 16 and engage the second plurality of gears 20 at the second end of the second motor 16. The vented protective cover 22 may be located at an end of the second motor housing 12 proximate the opening of the housing (not shown). The second plurality of gears 20 may be coupled with the rotational ring structure 14 through the vented protective cover 22, and the rotational ring structure 14 may be located proximate to the liquid dispensing section 13. The tubing 9 may communicate with the liquid dispensing section 13 and may be configured to dispose bubble generating liquid (not shown) via the plurality of liquid outlets 13*a* onto the individual rings of the rotational ring structure 14, which results in bubbles 24 when the second motor 16 and the fan 18 are in operation.

Referring now to FIGS. 1-4, in operation, when the trigger 6 is squeezed, the electrode 5 may activate the first motor 7*a* which may engage the first plurality of gears 19. The first motor 7*a* may be configured to siphon the bubble generating liquid from the reservoir 11 through the tubing 9 and pump the bubble generating liquid through the tubing 9 to the bubble generating dispensing section 13.

The bubble generating liquid may be dispensed through the plurality of liquid outlets 13*a* in the bubble generating dispensing section 13 and may be applied to the individual rings 34 on the rotational ring structure 14. A predetermined amount of bubble generating liquid may be dispensed through the plurality of liquid outlets 13*a* and onto the individual rings 34 in order to create a film covering the individual rings 34. In an embodiment, the predetermined amount is determined by the amount that would substantially reduce or prevent excess liquid from dripping off of the individual rings 34. However, if excess bubble generating liquid is dispensed through the plurality of liquid outlets 13*a*, the excess can drain through the drain 23, as shown in FIG. 3, and back into the reservoir 11. By having the discontinuous openings for the drain 23 and tubing 9 instead of an open top, proper liquid supply and drainage may be achieved while allowing the reservoir 11 to be substantially enclosed, thus preventing spills and mechanical failure.

While the first motor 7*a* is pumping the bubble generating liquid and applying the liquid to the individual rings 34, the second motor 16 may engage the fan 18, creating an air flow through the second motor housing 12. The second electric motor 16 may be configured to blow air through the vented protective cover 22 and the rotational ring structure 14, generating bubbles at the front of the barrel section 2*b* of the housing 2. In addition, the second motor 16 may rotate the rotational ring structure 14 about the central pivot 30 across the bubble generating dispensing section 13 so that a film may be formed on the each consecutive individual ring 34. So long as there is sufficient bubble generating liquid in the reservoir 11 and the batteries in the battery compartment 4 are charged and capable of powering the first motor 7*a* and the second motor 16 when the trigger 6 is engaged, a continuous stream of bubbles 24 may be created.

Figure 7:
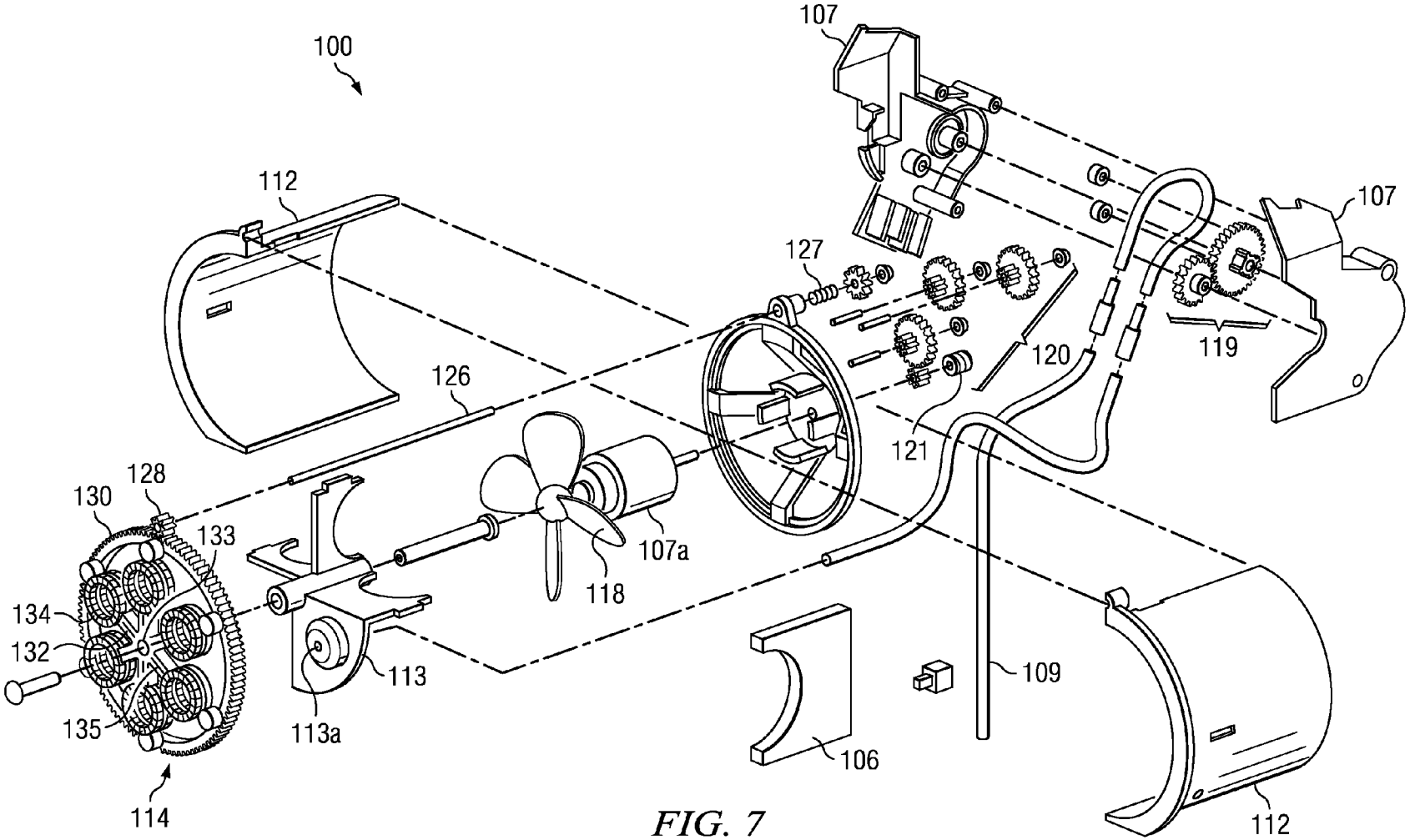
FIG. 7 is an exploded view of an internal configuration of a bubble generating apparatus, in accordance with the present disclosure.
Figure 8:
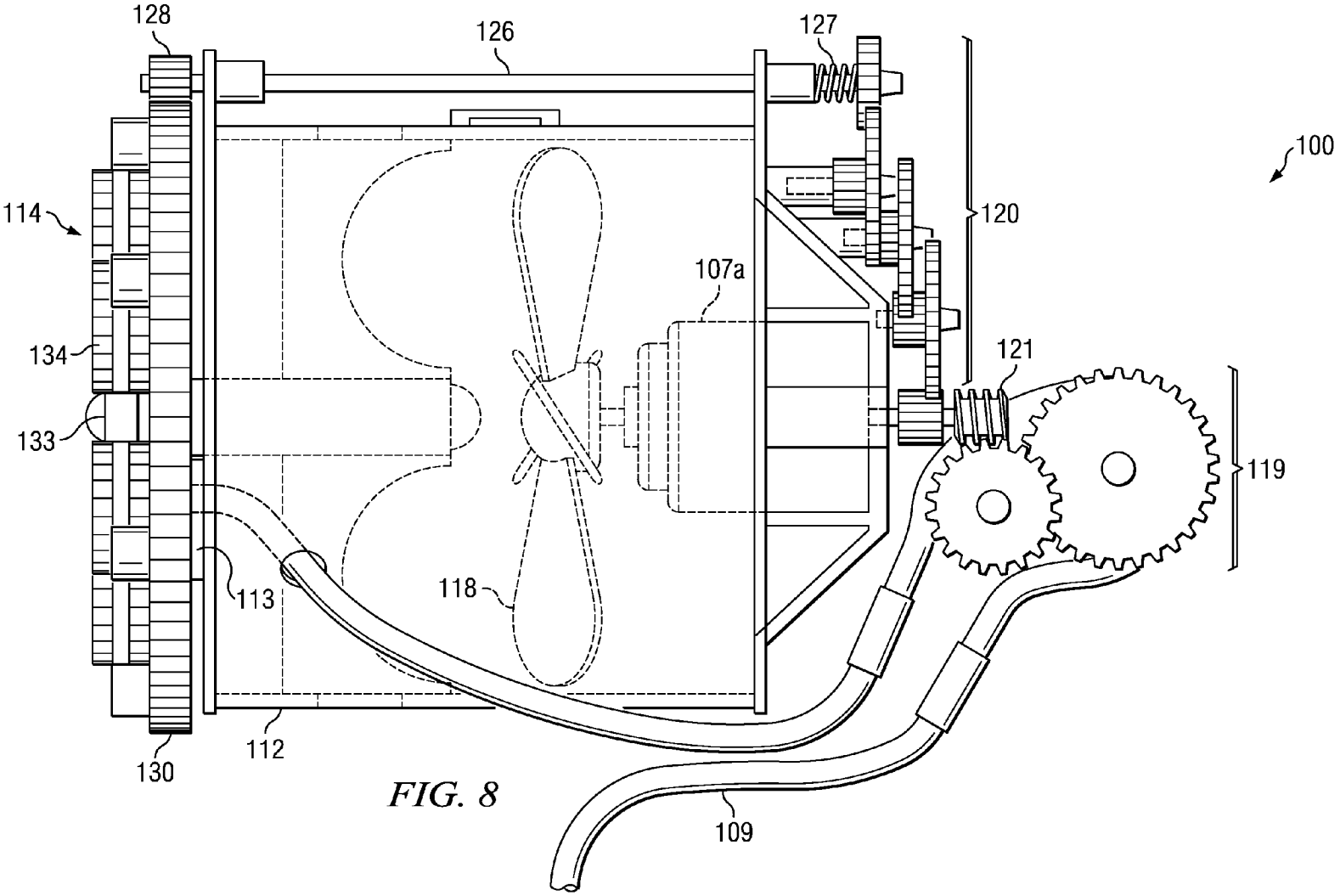
FIG. 8 is a partial cross-sectional view of a motor housing of FIG. 7 cut away to expose parts of the bubble generating apparatus, in accordance with the present disclosure.
Figure 9:
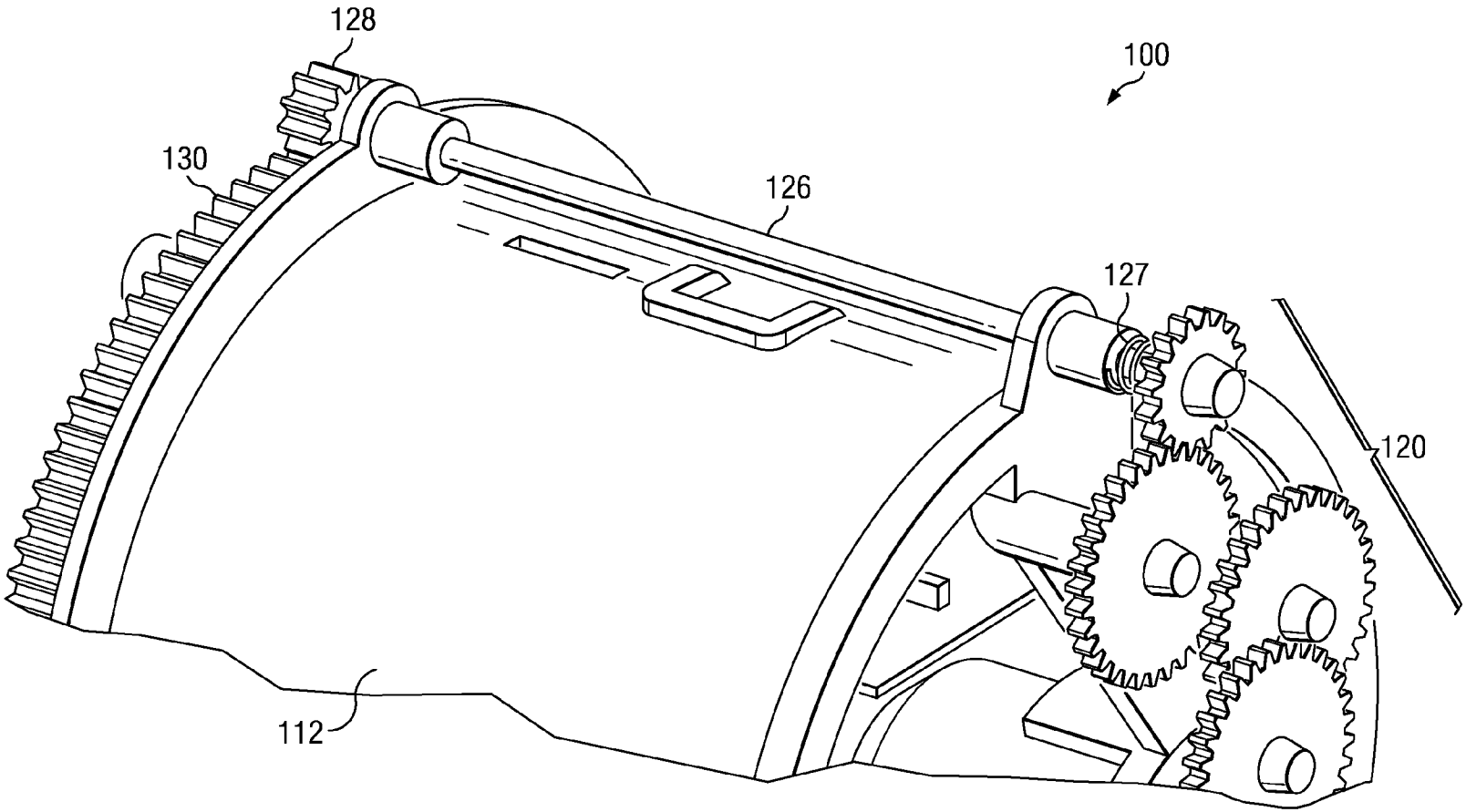
FIG. 9 is a perspective view of the motor housing of the bubble generating apparatus of FIGS. 7-8, in accordance with the present disclosure.
Figure 10:
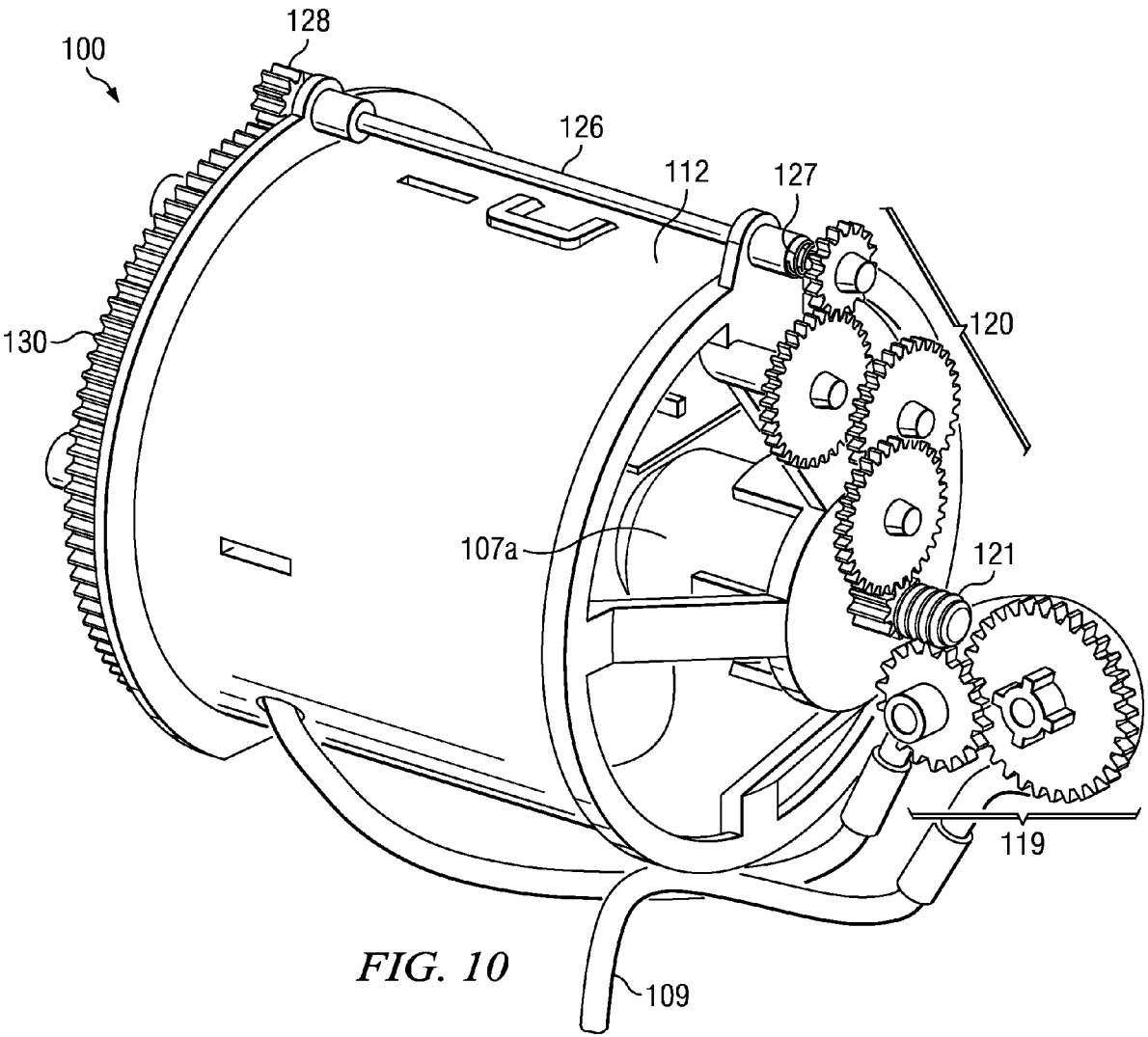
FIG. 10 is a perspective view of the motor housing of the bubble generating apparatus of FIGS. 7-9, in accordance with the present disclosure.
Figure 11:
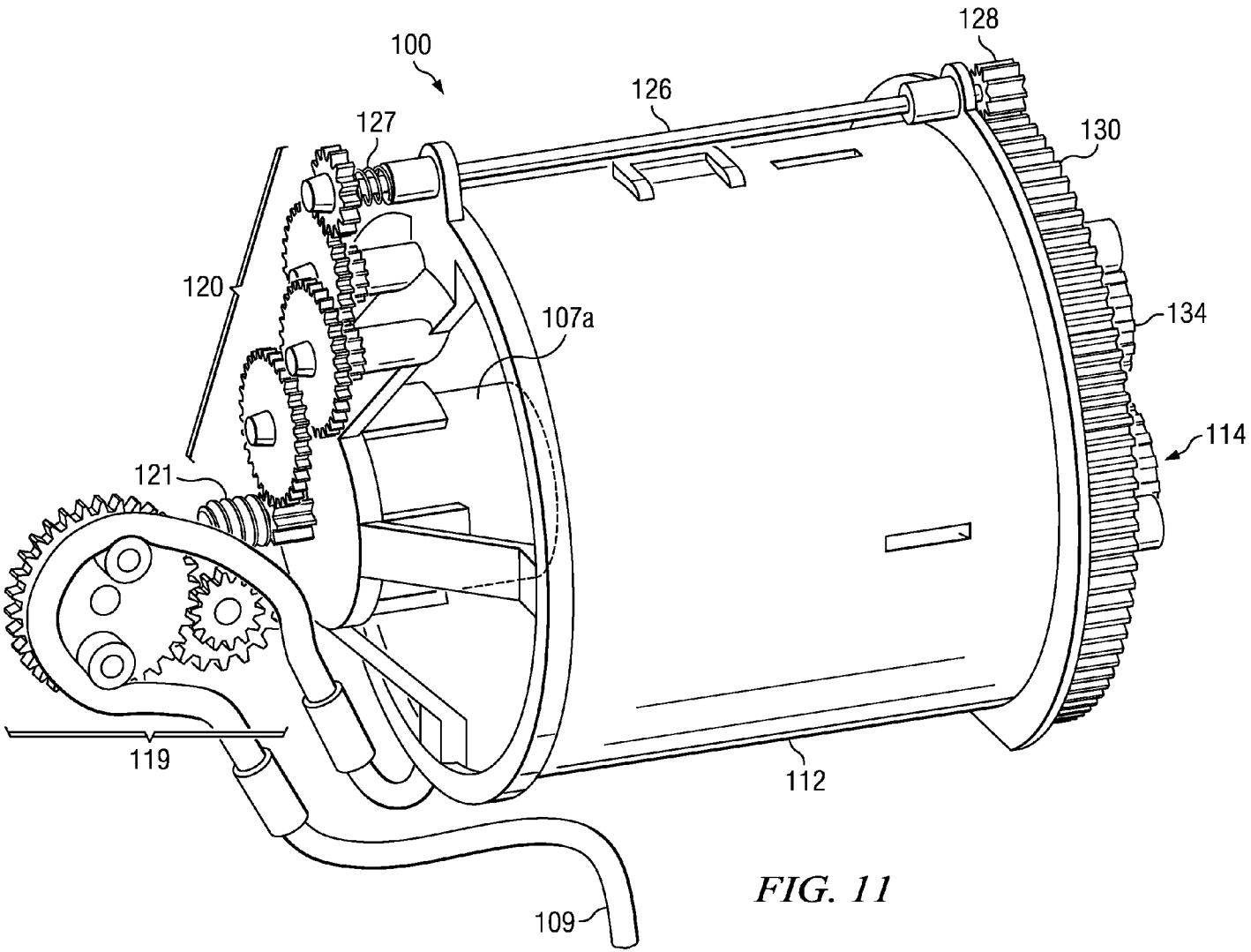
FIG. 11 is a perspective view of the motor housing of the bubble generating apparatus of FIG. 7-10, in accordance with the present disclosure.

FIG. 7 is an exploded view of an internal configuration of a second exemplary embodiment of a bubble generating apparatus 100. FIG. 8 is a partial cross-sectional side view of the bubble generating apparatus 100 of FIG. 7. FIG. 9 is a partial perspective view of the bubble generating apparatus 100 of FIGS. 7-8. FIG. 10 is a first perspective view of the bubble generating apparatus 100 of FIGS. 7-9. FIG. 11 is a second perspective view of the bubble generating apparatus 100 of FIGS. 7-10. Although not shown in FIGS. 7-11, the bubble generating apparatus 100 may include a housing comprising a handle section, a barrel section, and an opening, and a reservoir, configured as shown in the embodiments in FIGS. 1-4. Descriptions of these elements with respect to the bubble generating apparatus 1 is incorporated by reference with respect to the bubble generating apparatus 100 and will not be repeated here.

The bubble generating apparatus 100 may comprise a trigger 106, tubing 109, and a motor 107*a* that may be surrounded by a motor housing 112. In an embodiment, a first drive end of the motor 107*a* may be directed towards the rear, handle section (not shown) of the bubble generating apparatus 100 and may be coupled with a first plurality of gears 120 and a worm drive 121. The first drive end of the motor 107*a* may be configured to turn the first plurality of gears 120 and the worm drive 121. The worm drive 121 may be coupled with a second plurality of gears 119. The first plurality of gears 120 and the second plurality of gears 119 may be surrounded by a gear housing 107.

In an embodiment, a second drive end of the motor 107*a* may be directed towards an opening (not shown) in the front of the bubble generating apparatus 100 and may be coupled with a fan 118. The second drive end of the motor 107*a* may be configured to rotate the fan 118. A bubble generating dispensing section 113 may be located proximate to the fan 118. A rotational ring structure 114 may be located proximate to the bubble generating dispensing section 113 and proximate to the opening in the front of the housing. The rotational ring structure 114 may comprise one or more individual bubble rings 134 that are connected to a center hub 133 of the rotational ring structure 114 with one or more connecting arms 132. The rotational ring structure 114 may further comprise a circumferential gear 130 located about the outer circumference of the rotational ring structure 114. The rotational ring structure 114 may either be in direct contact with the bubble generating dispensing section 113 or close enough to the bubble generating dispensing section 113 so that bubble generating liquid can be applied directly from the bubble generating dispensing section 113 via an outlet 113*a* onto the one or more individual bubble rings 134 on the rotational ring structure 114. The proximity between the bubble generating dispensing section 113 and the rotational ring structure 114 may be configured to allow for a film of bubble generating liquid to form over the bubble rings 134 with minimized excess.

In an embodiment, it may be desirable to take advantage of the natural gravitational flow of liquid in the application of the bubble generating liquid from the outlet 113*a* onto the one or more individual bubble rings 134. As such, the motor 107*a* may be configured to rotate the rotational ring structure 114 opposite the directional of the gravitational flow of the bubble generating liquid. For example, as shown in the embodiment of FIG. 7, when looking at the rotational ring structure 114 head on in the opening of the housing (not shown), the bubble generating dispensing section 113 may be positioned in the lower right hand quadrant of the opening. In this configuration, the motor 107*a* may turn the rotational ring structure 114 in a counter-clockwise direction. If the bubble generating dispensing section 113 were to be positioned in the lower left hand quadrant of the opening, the motor 107*a* may turn the rotational ring structure 114 in a clockwise direction.

A rod 126 may be coupled with the first plurality of gears 120 and may run the length of the motor housing 112 to a rotational ring drive gear 128 disposed proximate to the rotational ring structure 114. The rotational ring drive gear 128 may be configured to mesh with the circumferential gear 130 located around the outer circumference of the rotational ring structure 114.

In operation, when the trigger 106 is squeezed, power delivered through an electrode (not shown) may drive the motor 107*a*, engaging the first plurality of gears 120 and the worm drive 121, and the worm drive may engage the second plurality of gears 119. The motor 107*a* and the second plurality of gears 119 may be configured to siphon bubble generating liquid from the reservoir (not shown) through the tubing 109 and pump the bubble generating liquid to the bubble generating dispensing section 113. An amount of bubble generating liquid may be dispensed through the outlet 113*a* and onto the individual rings 134 of the rotational ring structure 114 in order to create a film covering each of the individual rings 134. If an excess amount of bubble generating liquid were dispensed through the outlet 113*a* or if the bubble generating apparatus 100 were rotated 90 degrees vertically so that the opening (not shown) of the bubble generating apparatus 100 faces upwards, the excess liquid may drain to a trench 135 formed in each arm 132 of the rotational ring structure 114. These trenches 135 may be designed to prevent excess liquid from spilling into the housing and may be configured to re-direct the excess liquid back to the individual rings 134.

The motor 107*a* and the first plurality of gears 120 may be configured to rotate the rod 126, which in turn may rotate the rotational ring drive gear 128. The rotational ring drive gear 128 may be configured to mate with the circumferential gear 130 located about the outer circumference of the rotational ring structure 114 so that when the motor 107*a* runs, the first plurality of gears 120 rotate the rod 126, which rotates the rotational drive gear 128, which rotates the circumferential gear 130 and the rotational ring structure 114 in front of the bubble generating dispensing section 113. When the rotational ring structure 114 is rotated proximate to the bubble generating dispensing section 113, bubble generating liquid is dispensed through the outlet 113*a* onto each of the individual rings 134 of the rotational ring structure 114.

When the motor 107*a* is pumping the bubble generating liquid with the second plurality of gears 119 to the bubble generating dispensing section 113 and rotating the rotational ring structure 114 with the first plurality of gears 120, the motor 107*a* may also drive the fan 118, creating an air flow through the motor housing 112, from the rear of the bubble generating apparatus 100 to the opening (not shown) in the front of the bubble generating apparatus 100. The fan 118 may be configured to blow air through the rotational ring structure 114, generating bubbles at the front of the bubble generating apparatus 100.

The motor 107*a* may have a safety mechanism 127 designed to prevent the motor 107*a* from overheating if the rotational ring structure 114 becomes stuck or otherwise stops rotating. As shown in the embodiment shown in FIGS. 8 and 9, the safety mechanism 127 interconnects one of the first plurality of gears 120 and the rod 126 via friction. In the illustrated example, the safety mechanism may be a spring. In the event that the rotational ring structure 114 becomes stuck when the trigger 106 is engaged, the safety mechanism 127 would give away and become mechanically decoupled from the rod 126. As such, the motor 107*a* may continue to drive rotation of the first plurality of gears 120 without rotating the rod 126 or the rotation ring structure 114, thereby preventing the motor 107*a* from overheating.

Figure 5:
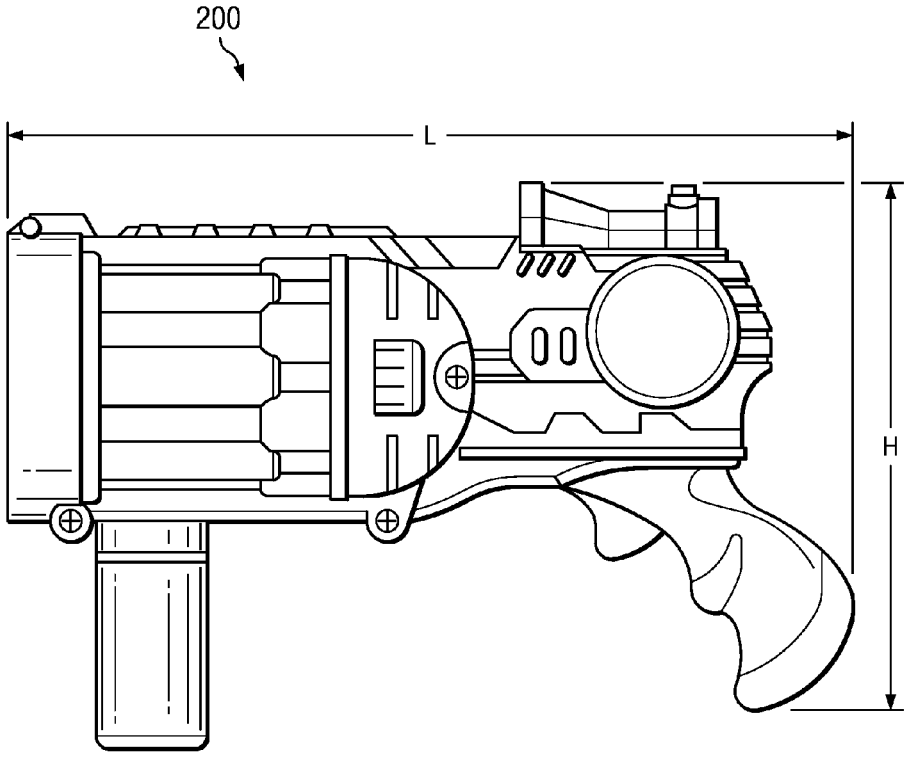
FIG. 5 is a side view of the bubble generating apparatus of FIGS. 1 and 7 with dimensions H and L depicted, in accordance with the present disclosure.
Figure 6:
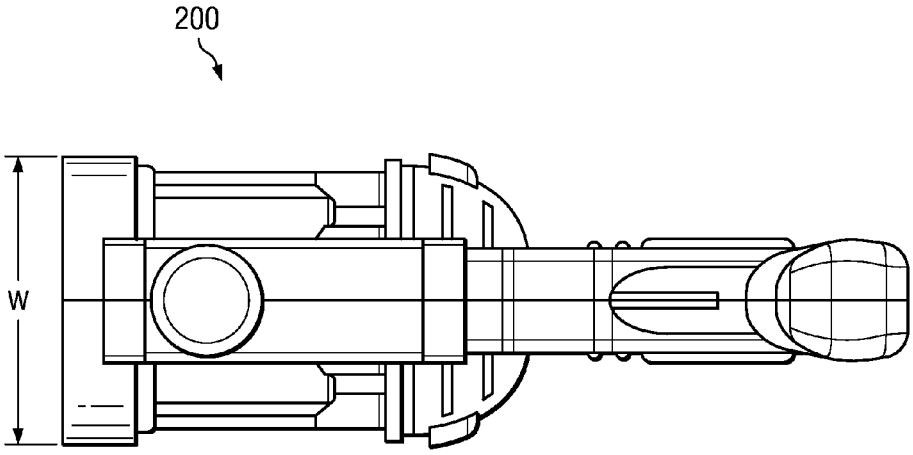
FIG. 6 is a top view of the bubble generating apparatus of FIGS. 1 and 7 with dimension W depicted, in accordance with the present disclosure.

FIG. 5 is a side view of a bubble generating apparatus 200 with dimensions H and L depicted. FIG. 6 is a top view of the bubble generating apparatus 200 of FIG. 5 with dimension W depicted, in accordance with the present disclosure. In FIGS. 5 and 6, novel dimensions may be shown.

In an embodiment, the height H of the bubble generating apparatus 200 may be between approximately 180 cm and 220 cm. More specifically, the height H of the bubble generating apparatus 200 may be between approximately 190 cm and 210 cm. Even more specifically, the height H of the bubble generating apparatus 200 may be approximately 200 cm.

In an embodiment, the length L of the bubble generating apparatus 200 may be between approximately 205 cm and 245 cm. More specifically, the length L of the bubble generating apparatus 200 may be between approximately 215 cm and 235 cm. Even more specifically, the length L of the bubble generating apparatus 200 may be approximately 225 cm.

In an embodiment, the width W of the bubble generating apparatus 200 may be between approximately 65 cm and 85 cm. More specifically, the width W of the bubble generating apparatus 200 may be between approximately 70 cm and 80 cm. Even more specifically, the width W of the bubble generating apparatus 200 may be approximately 75 cm.

The dimensions of the bubble generating apparatus 1 of FIGS. 1-4 and the bubble generating apparatus 100 of FIGS. 7-11 may be similar to or equal to the dimensions shown in the novel embodiments of FIGS. 5 and 6.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, a description of a technology in the "Background" is not to be construed as an admission that technology is prior art to any invention(s) in this disclosure. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A bubble generating apparatus comprising:

a housing comprising first and second end portions;

a rotational ring structure rotatably seated in the housing and disposed proximate to an opening defined in the second end portion of the housing, wherein the rotational ring structure comprises a plurality of individual rings;

a reservoir coupled with the housing and configured to store bubble generating liquid;

a fan that creates an airflow through the housing;

a liquid dispensing section disposed proximate to the rotational ring structure, wherein the liquid dispensing section blocks the airflow in a region larger than a size of one of the individual rings, the liquid dispensing section comprises a liquid outlet disposed within the blocked airflow, and the outlet is operable to dispose the bubble generating liquid onto the plurality of individual rings of the rotational ring structure, thereby creating a film of bubble generating liquid across the plurality of individual rings;

a conduit having a first end extending into the reservoir and a second end connected to the liquid dispensing section;

a siphoning mechanism operable to draw the bubble generating liquid from the reservoir and through the conduit to the liquid dispensing section;

a drive mechanism operable to rotate the rotational ring structure; and a motor operable to power the siphoning mechanism, the drive mechanism, and the fan;

wherein the rotational ring structure is disposed between the opening and the liquid dispensing section.

2. The bubble generating apparatus of claim 1, wherein the first end portion of the housing comprises a handle and the second end portion of comprises a barrel.

3. The bubble generating apparatus of claim 1, wherein a first end of the motor is proximate to the first end portion of the housing and a second end of the motor is proximate to the second end portion of the housing.

4. The bubble generating apparatus of claim 1, wherein the plurality of individual rings of the rotational ring structure are spaced circumferentially from each other.

5. The bubble generating apparatus of claim 1, wherein each individual ring of the rotational ring structure is connected to a central hub by an arm, wherein a front surface of each arm comprises a trench.

6. The bubble generating apparatus of claim 1, wherein the plurality of individual rings further comprise a plurality of individual ridges on one or more surfaces of each of the plurality of individual rings.

7. The bubble generating apparatus of claim 1, wherein the reservoir is disposed proximate to the second end portion of the housing.

8. The bubble generating apparatus of claim 1, wherein the liquid dispensing section is disposed proximate to the opening at the second end portion of the housing.

9. The bubble generating apparatus of claim 1, wherein the fan is coupled to a second end of the motor and proximate to the opening in the second end portion of the housing.

10. The bubble generating apparatus of claim 1, wherein the motor is operable to power the siphoning mechanism, the drive mechanism, and the fan substantially simultaneously.

11. The bubble generating apparatus of claim 1, wherein the drive mechanism further comprises a circumferential gear disposed on an outer circumference of the rotational ring structure;

a first plurality of gears coupled to the motor;

a connecting rod coupled to the first plurality of gears and running from the first end portion of the housing to the rotational ring structure at the second end portion of the housing; and a rotational drive gear coupled to the connecting rod and the circumferential gear of the rotational ring structure.

12. The bubble generating apparatus of claim 11, wherein the first plurality of gears rotate the connecting rod, the connecting rod rotates the rotational drive gear, and the rotational drive gear rotates the rotational ring structure.

13. The bubble generating apparatus of claim 1, wherein the siphoning mechanism further comprises:

a worm drive coupled to a first plurality of gears; and a second plurality of gears coupled to the worm drive.

14. The bubble generating apparatus of claim 13, wherein the siphoning mechanism is operable to engage an intermediate portion of the conduit and to siphon the bubble generating liquid from the reservoir through the conduit to the liquid dispensing section.

15. The bubble generating apparatus of claim 1, wherein when the fan is engaged, the fan blows air from the first end portion of the housing to the second end portion of the housing and through the film of bubble generating liquid across the plurality of individual rings comprising the rotational ring structure, creating one or more bubbles.

16. A bubble generating apparatus comprising:

a housing comprising first and second end portions;

a rotational ring structure rotatably seated in the housing and disposed proximate to an opening defined in the second end portion of the housing, wherein the rotational ring structure comprises a plurality of individual rings;

a reservoir coupled with the housing and configured to store bubble generating liquid;

a fan that creates an airflow through the housing;

a liquid dispensing section disposed proximate to the rotational ring structure, wherein the liquid dispensing section blocks the airflow in a region larger than a size of one of the individual rings, the liquid dispensing section comprises a liquid outlet disposed within the blocked airflow, and the outlet is operable to dispose the bubble generating liquid onto the plurality of individual rings of the rotational ring structure, thereby creating a film of bubble generating liquid across the plurality of individual rings;

a conduit having a first end extending into the reservoir and a second end connected to the liquid dispensing section;

a siphoning mechanism operable to draw the bubble generating liquid from the reservoir and through the conduit to the liquid dispensing section;

a drive mechanism operable to drive the rotational ring structure;

a first motor operable to power the drive mechanism and the fan; and a second motor operable to power the siphoning mechanism;

wherein the rotational ring structure is disposed between the opening and the liquid dispensing section.

17. The bubble generating apparatus of claim 16, wherein the plurality of individual rings of the rotational ring structure are spaced circumferentially from each other.

18. The bubble generating apparatus of claim 16, wherein the plurality of individual rings further comprise a plurality of individual ridges on one or more surfaces of each of the plurality of individual rings.

19. The bubble generating apparatus of claim 16, wherein the first end portion of the housing comprises a handle and the second end portion of the housing comprises a barrel.

* * * * *